US006206551B1

(12) United States Patent
Stubblefield, Jr.

(10) Patent No.: US 6,206,551 B1
(45) Date of Patent: Mar. 27, 2001

(54) FOLDABLE LANTERN REFLECTOR AND SHADE

(76) Inventor: Charles E. Stubblefield, Jr., 25841 Lariat Cir., Broken Arrow, OK (US) 74014

( * ) Notice: Subject to any disclaimer, the term of this patent is extended or adjusted under 35 U.S.C. 154(b) by 0 days.

(21) Appl. No.: 09/288,191

(22) Filed: Apr. 8, 1999

(51) Int. Cl.[7] ..... F21V 1/12

(52) U.S. Cl. ..... 362/360; 362/352; 362/367; 362/346; 362/307; 362/283

(58) Field of Search ..... 362/360, 352, 362/278, 356, 357, 367, 450, 346, 297, 294, 373, 307, 174, 175, 177, 283

(56) References Cited

U.S. PATENT DOCUMENTS

| | | | | |
|---|---|---|---|---|
| D. 121,992 | | 8/1940 | Griffith et al. . | |
| D. 222,809 | | 1/1972 | Ford | D48/4 |
| D. 243,034 | | 1/1977 | Marsh, Jr. | D48/16 D |
| D. 358,904 | | 5/1995 | Kelly | D26/128 |
| D. 383,243 | | 9/1997 | Fry et al. | D26/118 |
| 1,867,562 | * | 7/1932 | Burke | 362/360 |
| 3,767,904 | * | 10/1973 | Cook | 240/11.2 R |
| 3,787,676 | | 1/1974 | Korach | 240/108 R |
| 4,172,275 | | 10/1979 | Caverio | 362/159 |
| 4,393,439 | | 7/1983 | James, Jr. | 362/182 |
| 4,535,390 | | 8/1985 | Curtis et al. | 362/179 |
| 4,599,683 | | 7/1986 | Beckham et al. | 362/166 |
| 5,613,770 | * | 3/1997 | Cin, Jr. et al. | 362/367 |

* cited by examiner

*Primary Examiner*—Sandra O'Shea
*Assistant Examiner*—BeRtrand Zeade
(74) *Attorney, Agent, or Firm*—Head, Johnson and Kachigian

(57) ABSTRACT

A compactible shade for use with various camping lamps or lanterns. In one exemplary embodiment of the invention, multiple panels are interconnected to allow for a shade which can be reduced into a compacted arrangement. Further embodiments of the present invention include a handle notch for allowing a camping or lantern-style handle to be used while the compactible shade is installed on the lantern. Other embodiments allow for the shade to be constructed from a reflective material to direct the light from the lantern in a downward direction. A still further embodiment allows for the compactible shade to be constructed from translucent material for allowing diffused light to be emitted horizontally from the lantern while shielding a user's eyes from the harsh light emitted from the lantern.

12 Claims, 3 Drawing Sheets

FOLDABLE LANTERN REFLECTOR AND SHADE

REFERENCE TO PENDING APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

The present invention is directed to an apparatus and method for a lantern shade. More particularly, the invention is directed for use in a foldable lantern reflector and shade for a camping lantern. The invention has utility and application such as camping lanterns or portable light sources where it is desirable to have a light reflector and/or a lamp shade.

The placing of shades onto lamps is well known. Shade systems are shown in U.S. Design Pat. No. 358,904, issued to Kelly on May 30, 1995; and U.S. Pat. No. 3,787,676, issued to Korach on Jan. 22, 1974. Each of these patents is briefly outlined in the following discussion, and is hereby incorporated by reference.

U.S. Design Pat. No. 358,904 discloses a collapsible shade which is mounted on the upper portion of a lantern.

U.S. Pat. No. 3,787,676 discloses a collapsible lamp shade. This patent discloses a method for forming a collapsible lamp shade using upper and lower support rings which are assembled onto an outer covering made of a flexible material. This allows for the support rings to be removed and rotated and the flexible covering to be folded flat and placed with the support rings to form a collapsible re-assemblable lamp shade.

Both of these systems have particular disadvantages. U.S. Design Pat. No. 358,904 does not allow for the lamp shade to compact into an exceptionally small package for transportation and appears to be permanently mounted to the lamp for transportation purposes. This would not allow for easy removal of the lamp shade when its use is not required. U.S. Pat. No. 3,787,776 uses many parts which must be disassembled and reassembled and thus, may become lost during the transportation of the lamp shade. Additionally, this lamp shade does not appear to allow for the use of a lantern handle and does not appear to disclose its use on a portable camping style lantern.

The separate art of placing reflectors onto lanterns is also well known. Lantern reflector systems are shown in U.S. Design Pat. No. 121,992 issued to Griffith et al on Aug. 20, 1940; U.S. Design Pat. No. 222,809, issued to Ford on Jan. 4, 1972; U.S. Design Pat. No. 243,034 issued to Marsh, Jr. on Jan. 11, 1977; and U.S. Design Pat. No. 383,243 issued to Frye et al on Sep. 2, 1997. Additional United States Patents which show lantern reflectors are shown in U.S. Pat. No. 4,172,275 issued to Caverio on Oct. 23, 1979; U.S. Pat. No. 4,393,439 issued to James Jr. on Jul. 12, 1983; U.S. Pat. No. 4,535,390 issued to Curtis et al on Aug. 13, 1985; and U.S. Pat. No. 4,599,683 issued to Beckham et al on Jul. 8, 1986. Each of these patents is hereby incorporated by reference. Each of the lantern reflector patents discloses one or more methods for mounting a reflector in direct contact with or parallel to the lens or glass protecting the light source.

The most notable of these patents is U.S. Pat. No. 4,535,390 issued to Curtis et al on Aug. 13, 1985. This specification discloses a collapsible lantern reflector which can be folded into a compact configuration and stored in the bottom of the lantern. The reflector is formed from a pair of panels which are pivotally secured to each other allowing movement between a folded and unfolded position. When unfolded, the reflector is then inserted between the lantern frame and the globe for reflecting light out the opposite side of the lantern globe. When folded, the reflector is sized to fit within the confines of the base of the lantern.

The above identified and described lantern reflectors suffer from the drawbacks of being used to reflect light in a horizontal manner from the light source. Additionally, these lantern reflectors do not disclose how to make a lantern reflector which will reflect light downward below the lamp, and will protect the user's eyes from the light source like a lamp shade. Furthermore, these systems suffer from the drawback of being directly mounted in a parallel relationship with the lantern globe and do not allow full horizontal protection from the light source for the users.

Hence, there is a need for an eloquently simple, foldable lantern shade and reflector.

SUMMARY OF THE INVENTION

In accordance with the present invention, an improved foldable lantern reflector and shade is provided which addresses the drawbacks of the prior art devices. In one of the exemplary embodiments of the present invention the lantern reflector and shade includes multiple panels which are pivotally connected to form a downwardly reflecting lantern shade.

In accordance with one embodiment of the present invention, a foldable lantern reflector and shade is provided comprising of multiple panels which are pivotally attached and can be assembled into a lantern shade and reflector, and which may also be pivoted to a compacted and easily transportable form.

In accordance with one example of the present invention, the unit is equipped with rivets for pivotally connecting the reflector panels.

In accordance with a still further example of the present invention, the unit is equipped with multiple panels with a connection means for attaching the panels together.

Yet another example of the present invention includes multiple panels connected by holders.

In accordance with another example of the present invention, the unit is equipped with a notch or opening for allowing a lantern handle to pass through the lantern shade.

In accordance with a further example of the present invention, the unit is equipped with reflective panels to redirect the light emitted from the lantern.

In accordance with a still further example of the present invention, the multiple panels are made from translucent material to shield the user's eyes from the harsh light emitted by the lantern's light source.

The principal objects of the present invention is to provide a collapsible shade for use with a portable lantern.

Another object of the present invention is to provide a reflector for downwardly casting horizontal light emitted from a lantern.

A further object of the present invention is to provide for a translucent light shade which may be compacted into an easily transportable arrangement.

A further object of the present invention is to provide for a lantern shade with an opening for allowing a lantern handle to pass through the lantern shade so that the lantern shade and lantern handle may be used concurrently.

A still further object of the present invention is to provide for a translucent lantern shade which is easily compactible for transportation purposes.

An additional object of the present invention is to provide a lantern shade configuration which allows for proper ventilation of the lantern.

Other objects and further scope of the applicability of the present invention will become apparent in the detailed description to follow, taken in conjunction with the accompanying drawings wherein like parts are designated by like reference numerals.

DETAILED DESCRIPTION OF THE PREFERRED EMBODIMENTS

Figure 1:
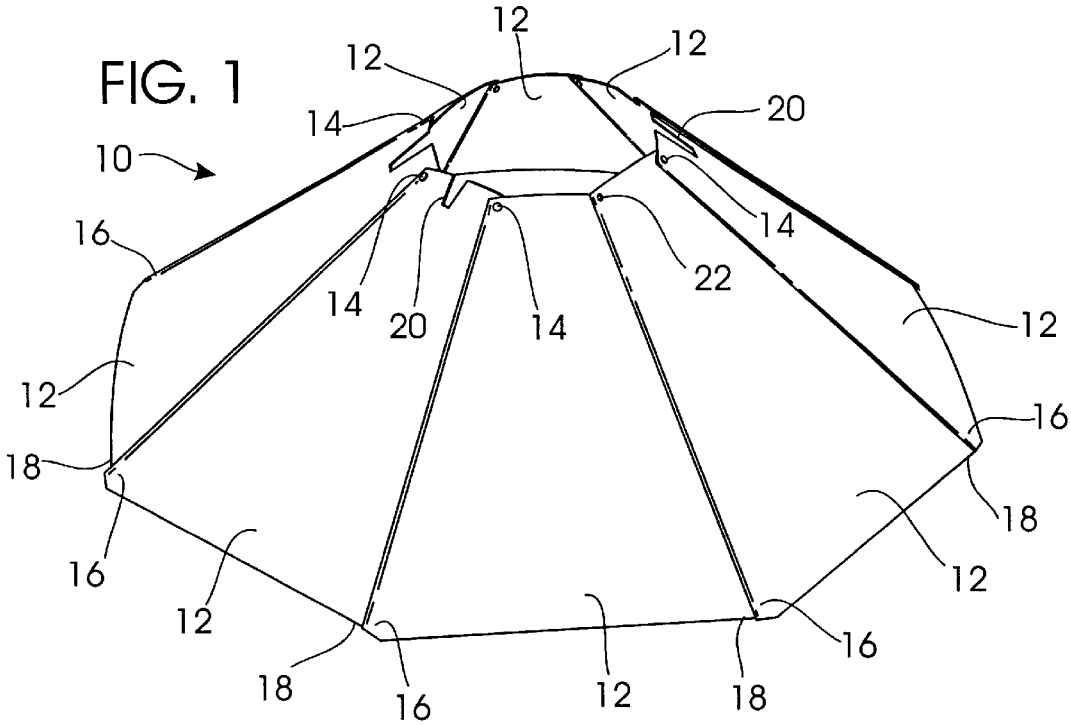
FIG. 1 is a perspective view of the base unit of the invention.

In accordance with an exemplary embodiment of the present invention as shown in FIG. 1, a compactible shade apparatus, device, or assembly is generally designated by the reference numeral 10. The compactible shade 10 includes as major components panels 12 and panel connection means 14.

With reference to FIG. 1, there is shown the basic embodiment to the invention consisting of panels or plates 12 which are pivotally connected by connection means 14, and interlocked by holders 16 and 18. In this embodiment of the invention it is seen that panels 12 are pivotally connected by the panel connection means 14 to allow for the unit to be expanded into the shape of a shade.

The panels 12 are generally constructed of a heat resistant, semi-rigid yet flexible material such as steel or aluminum sheeting, plastics, or other appropriate heat-resistant materials.

The panel connection means 14 can be constructed from a rivet, bolt, screw, pivotal interlocking snap, or the like which interlocks holes in the requisite panels, or other means for hingably connecting panels together may also be used. While the preferred embodiment of the invention discloses that adjacent panels are riveted together, it is also envisioned the panels could be hingably connected by a flexible or piano type hinge and the like to allow for the panels to slide or fold together instead of hingably collapsing together. However, because this embodiment of the shade is designed to be lightweight for camping and traveling purposes, the preferred embodiment uses a simple rivet connection to interconnect the adjacent panels.

The adjacent panels 12 are interlocked by a first holder 16 and a second holder 18 which are disposed on opposite sides of each panel 12. The first holder 16 and the second holder 18 interlock to hold adjacent panels in a fixed relationship. In the exemplary embodiment of this invention, the panels 12 are constructed from a galvanized steel, and one edge of each panel is folded upwards to form a holder 16 on the top of the panel, and the opposite edge of the panel is folded downward to form a second holder 18 which will mate with the first holder 16 on an adjacent panel 12. These holders 16 and 18 can be used to connect the adjacent edges of the panels 12 when the unit is arranged in a shade configuration. This allows for the entire interconnected unit of panels 12 to maintain the shape of a shade while mounted on a lantern.

Because the interlocking holders 16 and 18 are only necessary when the material has been sufficiently lightened for transporting the unit in a camping or other associated environment, it is envisioned that the holders 16 and 18 would not be necessary if a sufficiently rigid panel 12, a curved panel 12, or a sufficiently rigid connection means 14 were to be used to hold the panels 12 in position. Therefore, it is envisioned that this shade could be constructed from panels 12 which are connected through the connection means 14 and would not require the holders 16 and 18.

An alternative embodiment of the invention would allow for the holders 16 and 18 to connect the panels 12 in the compacted arrangement, and then allow for separation of the panels 12 for assembly into a shade arrangement. In this alternative embodiment, the connection means 14 would not be necessary. Thus, the shade 10 could be constructed from multiple panels 12 that can be connected together in both a compacted arrangement and a shade arrangement by holders 16 and 18.

The connected arrangement of panels is called a panel arrangement and it may be connected together by the connection means 14 or alternatively by the holders 16 and 18.

Figure 2:
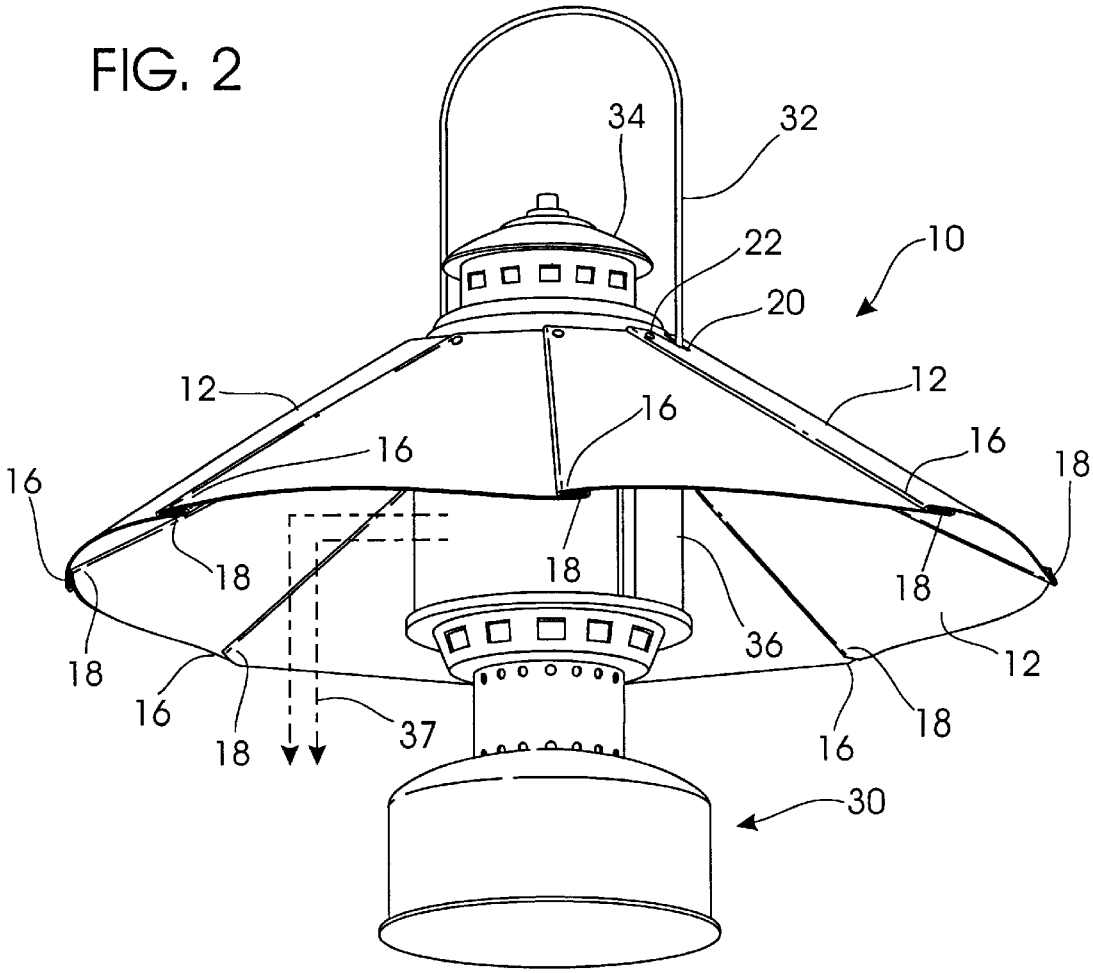
FIG. 2 is a perspective view of the base unit of the invention from underneath showing the invention mounted on a typical camping lantern.

As shown in FIG. 2, the shade 10 may be mounted on a lantern 30. The shade 10 may have notches 20 which allow for the handle 32 of the lantern 30 to extend upwardly past the shade 10. The shade 10 fits around the upper portion of the lantern 30 as shown by the extension of the lantern top 34 extending through the shade 10. This allows for the lantern shade to be directly supported by the top of the 34 of the lantern 30 and also allows the vents 35 of the lantern to allow for proper ventilation. FIG. 2 also shows how the reflective surface of the inner part of the shade 10 allows for the horizontal light 37 emitting from the lantern globe 36 to be redirected in a downward direction.

As shown in FIGS. 1 and 2, another aspect of the present invention is shown by the handle notch 20. The handle notch 20 allows for the handle of the lantern to extend through the upper end of the compactible shade 10 so that the shade may be used while a lantern is being carried or hung by its handle. This allows the lantern to be hung from a suitable height so that the lantern acts much like a ceiling light in a normal room and provide light from an overhead position. Note that this notch 20 comes in 2 sizes and allows for the shade to be placed on different sized lanterns. Alternatively, if the top 34 of the lantern extends past the edge of the handle assembly, then a notch would not be necessary and the shade could be suspended from the top 34 of the lantern and used without a handle notch. However, this approach limits the usefulness of the lantern shade because the opening on the unit manufactured to clear the handle on a large lantern would be too large for the smaller lantern sizes. Therefore, the preferred embodiment uses two paris of notches 20 to adapt for the different sizes of lanterns. The first pair of notches allows the lantern shade to fit smaller lanterns and the associated smaller handle assembly, and the second pair of notches 20 allows the shade to fit the larger sized lanterns and the larger handle assemblies.

When a lantern is mounted in an overhead position without a lantern shade, the lantern will provide mainly horizonal light. By installing a the shade 10 constructed from a highly reflective material, it is also envisioned the shade may act as a reflector to redirect the horizontal light 37 from the lantern in a downward direction. Because normal lanterns do not provide light directly below the position of the lantern, the lantern has to be hung at a distance away from the area where the light is desired. This distance reduces the amount of light provided by the lantern. By constructing and using a shade 10 which is constructed from a reflective material and hanging the lantern directly over the area to be lighted, the horizontal light from the lantern may be redirected and concentrated below the lantern to provide an improved lighting method.

Figure 3:
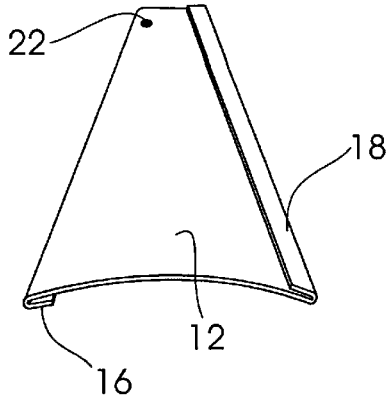
FIG. 3 is a plan view of a single panel of the present invention.

As shown in FIG. 3 of the drawings, a single plate or panel of the shade 10 of the present invention is shown. This plate 12 includes a pivotal mounting hole 22 for attachment of the connection means 14 along with a first holder 16 and a second holder 18. The exemplary form of holders 16 and 18 that are constructed by bending the plate 12 of the invention, as previously described, can be easily understood from FIG. 3.

Figure 4:
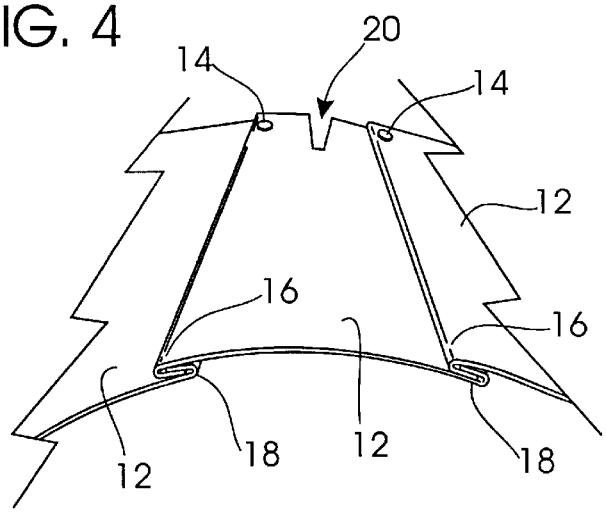
FIG. 4 is a detailed view showing the interconnection of the panels shown in FIG. 3.

FIG. 4 of the drawings shows how the plates shown in FIG. 3 of the drawings interconnect. As shown in FIG. 4, the plates 12 interconnect through the holder means 16 and 18 to allow for the plates to interlock and maintain the shade configuration. As shown in this configuration, the plates 12 are pivotally connected by a connection means 14 and may or may not include a handle notch 20 in the appropriate positions.

Figure 5:
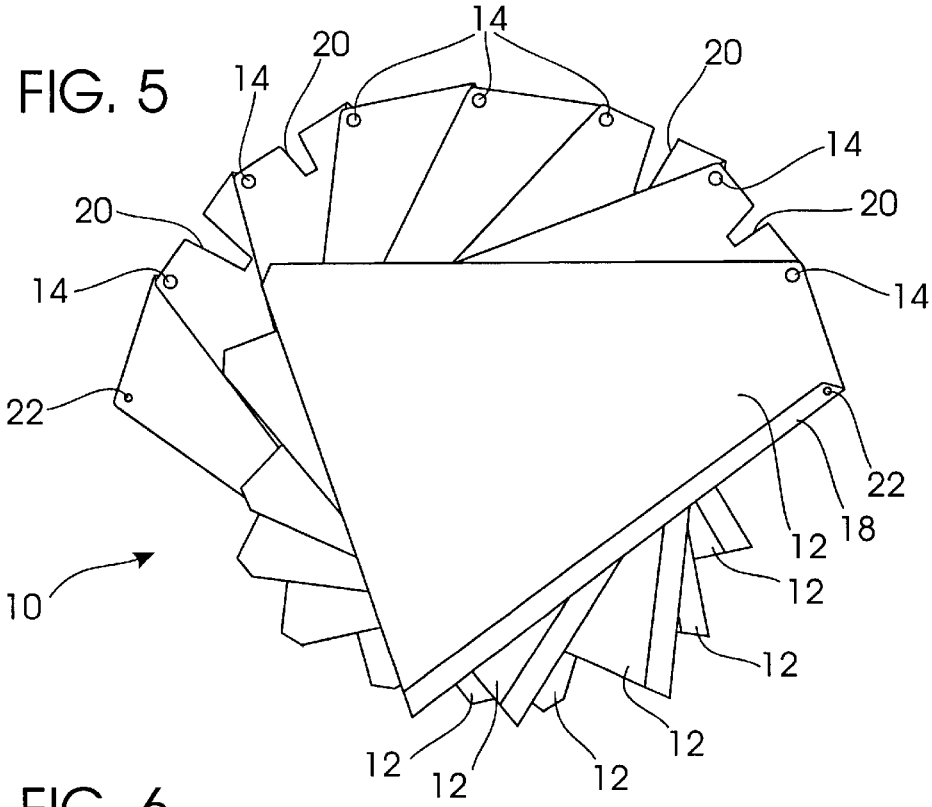
FIG. 5 is a plan view of the unit compacted into its substantially flat arrangement.

As shown in FIG. 5 of the drawings, one pair of adjacent plates are not connected by the connection means 14, so that the holder means 16 and 18 may be detached, and the unit folded or compacted into a substantially flat arrangement. This view shows how the plates 12 are pivotally moved around the connection means 14 to rotate into a compacted arrangement.

Figure 6:
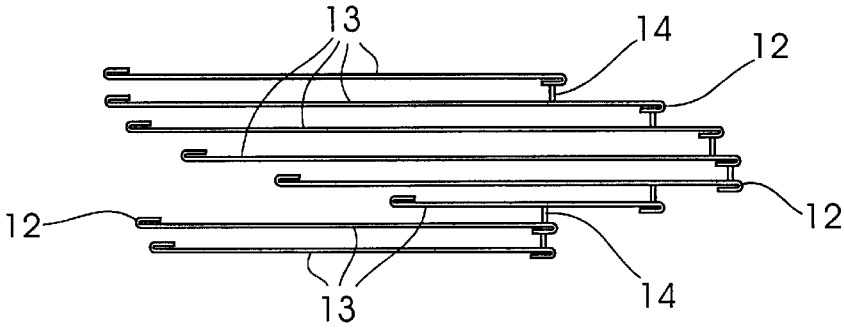
FIG. 6 is a schematic representation of the end view of the compacted shade in its substantially flat arrangement.

As shown in FIG. 6 of the drawing, the compacted arrangement of FIG. 5 is shown with the interconnection of the various plates by the connecting means 14. As shown by a comparison of the expanded shade 10 as shown in FIG. 1 versus the compacted arrangement shown in FIG. 6, it may be seen that each of the plates 12 flexes between a curved position as shown in FIG. 1 to a substantially flat arrangement as shown in FIG. 6. Thus, for the connection means 14 of the exemplary embodiment as described for the present embodiment, it is necessary for the plates 12 to be made of a semi-rigid yet flexible material. Alternatively, the connection means could allow for the bending of the connection means to allow for rigid plates 12 to be constructed into a circular arrangement for use on a lantern. Another possibility is that the design could be made from curved panels that are connected together to be moved into a compacted arrangement by placing the main surface areas 13 of adjacent panels 12 next to other panels 12 to allow for a compacted storage arrangement and rearranging the panels 12 to an expanded arrangement by placing the edges of the panels together.

Figure 7:
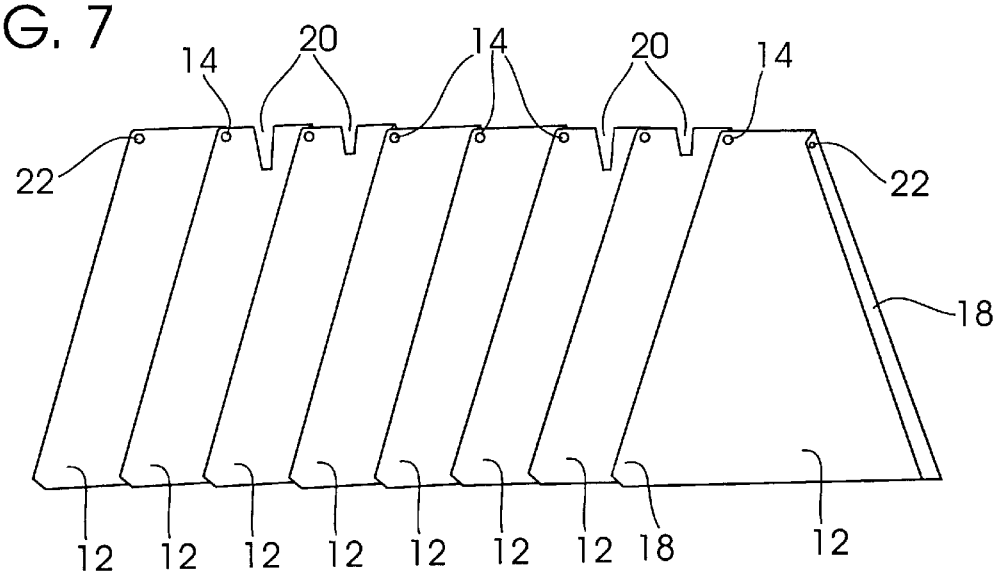
FIG. 7 of the drawings is a plan view of the unit compacted into a linear form.
Figure 8:
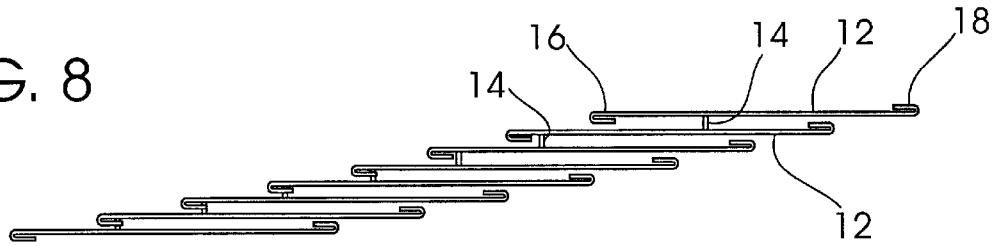
FIG. 8 is an end plan view of the linear arrangement of FIG. 7.
Figure 9:
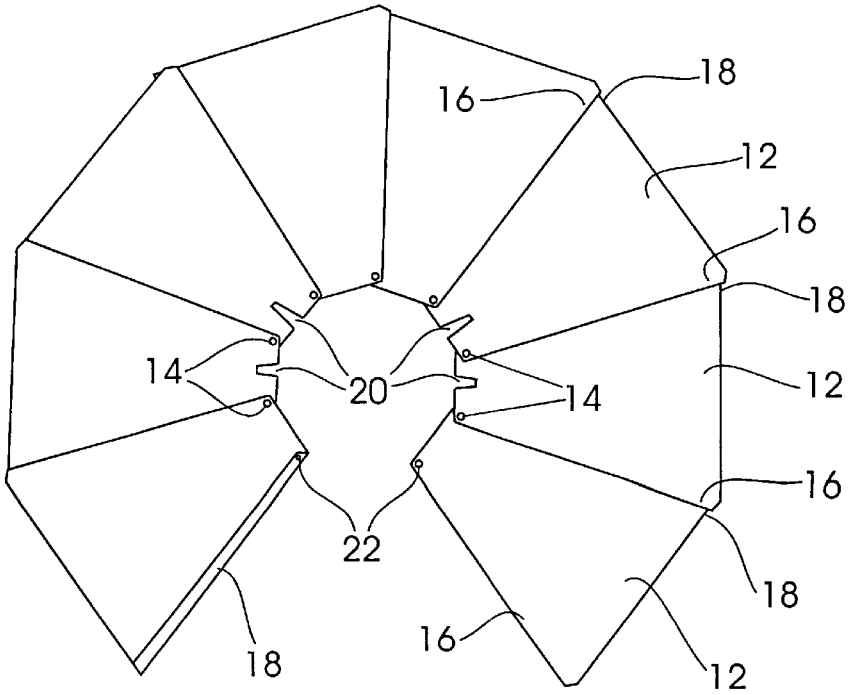
FIG. 9 is a plan view of the unit expanded on a flat surface before forming a cone shape.

As shown in FIGS. 5, 7 and 9, the unit may be laid out onto a flat surface and fanned out to lock together the plates 12 by interconnecting the first holder 16 and the second holder 18 on all but one set of the adjacent plates 12. From the compacted arrangement shown in FIG. 5 of the drawings, the unit may be expanded to a linear relationship as shown in FIG. 7. At this point the overlapping relationship of the panels 12 may be seen. The unit then may be further expanded to the semi-circular arrangement shown in FIG. 9. FIG. 9 of the drawings shows the unit laid out on a substantially flat surface and fanned out to interlock the first holder 16 and the second holder 18 of all but one of the adjacent panel points. From this position the remaining unconnected first holder 16 and second holder 18 may be interconnected to form the unit into a conical shape such as that shown in FIG. 1. Thus, a method may be seen for constructing a lantern shade for multiple interconnected panels.

In the preferred embodiment of the invention, all of the materials are manufactured from a galvanized steel which allows for the unit to be used in external environments without the rust or corrosion that is associated with metals like plain carbon steel. A galvanized or stainless steel embodiment may also be polished to allow for a reflective surface to redirect the primarily horizontal lantern light to be directed downwardly from the light source. An important consideration for use on gas powered lanterns or high output lanterns is the heat of the light source. In gas powered lanterns, the unit should be constructed from a material that is unaffected by the heat of the burning gas. Therefore, a metal or other high temperature material should be chosen. Alternative arrangements would also allow for the panels 12 to be constructed from a translucent material to allow for some of the light to filter through the lantern shade.

As previously suggested, another embodiment of the invention would allow for the panels or plates 12 to be attached by a connection means 14 such as piano style hinges to allow for the unit to fold accordion style. An alternative arrangement would allow for the plates to fold in upon themselves. This can be accomplished by selectively increasing the size of the plates and the thickness of the piano hinge to allow for each plate to fold against the earlier folded arrangement in a circular type folding arrangement.

A further embodiment of the invention uses a high temperature holder, such as a high temperature hook and loop holder, such as that manufactured under the trade name Velcro®, which is used to assemble and disassemble the panels or plates. In this embodiment, the holder is used to connect the panels in either the compacted arrangement or the shade arrangement, but allows for the panels to be disconnected when they are being changed from one form to another. The ideal method of this embodiment allows for the hook and loop holder to be used to hold the unit together in both the compacted arrangement and the open shade arrangement. By placing one side of the attachment holder on both ends of the upper surface, and the mating type of holder on the ends of the lower surface, the plates may be held together by the holders in both the expanded and compacted arrangements. Thus, the unit may have a first end with a female holder on the upper surface and a male holder on the lower surface and a second end with a similar arrangement. In this manner, the female and male holders will attach when the units are all stacked with the upper surface up and all of the first ends above one another. Additionally, the units may be stacked in an offset manner so that the holder on the left or first upper surface of a first plate will attach to the holder on the right or second lower surface of a second plate. These attachments may continue until a shade is constructed in the manner disclosed in FIG. 1. In this manner, a shade may be constructed from a multitude of similar panels that may held in either a compacted arrangement, or a shade type of arrangement.

A further alternative embodiment uses a magnetic strip on one edge of the panels as a first holder and the steel of the connecting panel as the second holder. Thus, the unit is constructed from metal panels 12 and a magnetic holder 16 attached to one end of the panels. The magnetic holder then uses the adjacent steel of an adjacent panel 12 as the second holder to hold the panels 12 together in either the expanded shade arrangement or the compacted arrangement.

While the foregoing detailed description has described the preferred embodiment of the compactible shade in accordance with this invention, it is to be understood that the above description is illustrative only and not limiting of the disclosed invention. Thus, the invention is to be limited only by the claims as set forth below.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A compactable shade for fuel burning lanterns, comprising:

a first panel having a first and second holder means formed along generally opposite edges of said panel for facilitating attachment of said first panel to a second panel;

a second panel pivotally connected to said first panel and having a first and second holder means formed along generally opposite edges of said panel for facilitating interlocking attachment of said second panel to said first panel.

2. The shade apparatus of claim 1, wherein a first holder of a first panel interlocks with a second holder of a second panel.

3. The shade apparatus of claim 1, further comprising a plurality of first and second panels each interlocked with the one another via said first and send holders to form a conical shape.

4. The shade apparatus of claim 3, further comprising:

at least one handle notch on at least two of said panels, said notches to facilitate passage therethrough of a fuel burning lantern handle.

5. A compactable shade for fuel burning lanterns, comprising:

a plurality of pivotally connected first and second panels each having a first and a second holder means formed along generally opposite edges of said panels, said plurality of pivotally connected panels interlocked with one another via said first and send holder means to form a conical shape.

6. The shade apparatus of claim 5, further comprising at least one handle notch on at least two of said panels, said notches to facilitate passage therethrough of a fuel burning lantern handle.

7. The shade apparatus of claim 5 wherein said panels so interlocked reflect light emanating from a fuel burning lantern.

8. The shade apparatus of claim 5 wherein said panels so interlocked allow light emanating from a fuel burning lantern to translucently pass through said panels.

9. The shade apparatus of claim 5 wherein said panels so interlocked allow fuel vapors and heat emanating from a fuel burning lantern to traverse the underside of said interlocked panels and disperse into the atmosphere.

10. A compactable shade for fuel burning lanterns, comprising:

a plurality of first and second panels pivotally connected to one another each panel having a first and a second holder means formed along generally opposite edges of said panels, said plurality of panels interlocked with one another via said first and send holder means and wherein said panels can be connected to form both an expanded shade arrangement and a compacted arrangement.

11. The shade apparatus of claim 10, further comprising at least one handle notch on at least two of said panels, said notches to facilitate passage therethrough of a fuel burning lantern handle.

12. A method for assembling a lantern shade, comprising:

interlocking multiple pivotally attached panels together to form a fuel burning lantern shade.

* * * * *